US010751860B2

(12) United States Patent
Hu

(10) Patent No.: US 10,751,860 B2
(45) **Date of Patent: *Aug. 25, 2020**

(54) ELECTRIC RAPID RATCHET WRENCH AND METHOD OF USING THE SAME

(71) Applicant: Bobby Hu, Taichung (TW)

(72) Inventor: Bobby Hu, Taichung (TW)

(73) Assignee: Bobby Hu, Taichung (TW)

( * ) Notice: Subject to any disclaimer, the term of this patent is extended or adjusted under 35 U.S.C. 154(b) by 0 days.

This patent is subject to a terminal disclaimer.

(21) Appl. No.: 15/437,607

(22) Filed: Feb. 21, 2017

(65) Prior Publication Data

US 2018/0117744 A1 May 3, 2018

(30) Foreign Application Priority Data

Oct. 28, 2016 (TW) ..... 105135043 A

(51) Int. Cl.
*B25B 21/00* (2006.01)
*B25B 13/46* (2006.01)
*B25B 23/14* (2006.01)

(52) U.S. Cl.
CPC ..... *B25B 21/004* (2013.01); *B25B 13/465* (2013.01); *B25B 21/00* (2013.01); *B25B 23/141* (2013.01)

(58) Field of Classification Search
CPC . B25B 21/004; B25B 13/465; B25B 23/0035; B25B 23/141; B25B 21/00; B25B 21/002; B25B 13/463

(Continued)

(56) References Cited

U.S. PATENT DOCUMENTS 2,614,418 A 10/1952 Shaff
6,062,939 A * 5/2000 Parker ..... A63H 33/3072 446/145

(Continued)

FOREIGN PATENT DOCUMENTS

CN 201020685 Y 2/2008
CN 201065044 Y 5/2008

(Continued)

OTHER PUBLICATIONS

CN105397697A (Year: 2016).*

(Continued)

*Primary Examiner* — David B. Thomas
*Assistant Examiner* — Thomas Raymond Rodgers
(74) *Attorney, Agent, or Firm* — Viering, Jentschura & Partner MBB

(57) ABSTRACT

An electric rapid ratchet wrench includes a driving device mounted in a body to which a power device is mounted. A transmission device is mounted between the driving device and the power device and is rotatably mounted to the body. The transmission device transmits a torque from the power device to drive the driving device. A clutch device is mounted between the driving device and the power device. The clutch device includes a driven member and a driver member movable in a radial direction perpendicular to a rotating axis to disengageably engage with the driven member. When a large resistance larger than the torque of the power device is encountered at a position while the driving device is driving a fastener, the driver member repeatedly engages with and disengages from the driven member. The body is manually rotatable to forcibly drive the fastener through the position via the driving device.

11 Claims, 8 Drawing Sheets

(58) Field of Classification Search
USPC ..... 81/475
See application file for complete search history.

(56) References Cited

U.S. PATENT DOCUMENTS

| | | | | |
|---|---|---|---|---|
| 6,457,386 | B1 * | 10/2002 | Chiang | B25B 13/465 81/57.29 |
| 7,082,859 | B2 * | 8/2006 | Huang | B25B 13/463 81/62 |
| 7,267,033 | B1 * | 9/2007 | Lai | B25B 13/465 81/57.29 |
| 7,444,902 | B1 * | 11/2008 | Lin | B25B 13/465 81/57.29 |
| 8,800,410 | B1 | 8/2014 | Huang | |
| 9,457,457 | B2 * | 10/2016 | Chiang | B25B 13/465 |
| 9,751,196 | B2 | 9/2017 | Hu | |
| 2008/0271574 | A1 | 11/2008 | Lin | |
| 2014/0109729 | A1 | 4/2014 | Wang | |
| 2016/0075002 | A1 | 3/2016 | Hu et al. | |
| 2016/0075003 | A1 | 3/2016 | Hu et al. | |
| 2016/0339568 | A1 | 11/2016 | Hu | |

FOREIGN PATENT DOCUMENTS

| | | | | |
|---|---|---|---|---|
| CN | 202805021 | U | | 3/2013 |
| CN | 105397697 | A | * | 3/2016 |
| DE | 102016108663 | A1 | | 11/2016 |
| JP | S62136378 | A | | 6/1987 |
| JP | H0472667 | B2 | | 11/1992 |
| JP | 3198345 | U | | 7/2015 |
| TW | M266129 | U | | 6/2005 |
| TW | M274194 | U | | 9/2005 |
| TW | 201611964 | A | | 4/2016 |
| TW | I571360 | B | | 2/2017 |
| TW | I571361 | B | | 2/2017 |

OTHER PUBLICATIONS

Office Action for the corresponding German Patent Application No. 10 2017 107 784.7 dated May 14, 2019, 6 pages (for reference purpose only).

Non-final Office Action for the corresponding Taiwanese Patent Application No. 2018 155 29 dated May 3, 2017, 10 pages (for reference purpose only).

* cited by examiner

ELECTRIC RAPID RATCHET WRENCH AND METHOD OF USING THE SAME

BACKGROUND OF THE INVENTION

The present invention relates to an electric ratchet wrench and, more particularly, to an electric rapid ratchet wrench and a method of using the electric rapid ratchet wrench.

U.S. Pat. No. 8,800,410 discloses a ratchet wrench with a direction switching structure. The ratchet wrench includes a wrench body, a ratchet wheel, a ratcheting member, and a switching member. The ratchet wheel is rotatably mounted in the wrench body and can couple with a socket. The ratcheting member is mounted in the wrench body and is selectively engaged with the ratchet wheel by using a left half portion or a right half portion of ratchet teeth of the ratcheting member to switch the rotating direction of the ratchet wheel. The switching member is pivotably mounted in the body and abuts the ratcheting member.

A user has to grip the wrench body and repeatedly rotate the wrench body in opposite directions to drive the socket to thereby drive a fastener, such as a nut, coupled with the socket, which takes the user a long time doing so.

Electric wrenches have been provided to save the time for repeatedly rotating the wrench body in opposite directions. Electric wrenches generally include a power-driven motor, a driving member for coupling with a nut, and a transmission member between the motor and the driving member. An end of the transmission member is connected to and driven by the power-driven motor. The other end of the transmission member is connected to the driving member. Thus, the transmission member is driven by the motor to synchronously rotate the driving member to thereby drive the fastener coupled to the driving member.

Long bolts are commonly used on building construction sites which are usually located outdoors. The long bolts exposed outdoors are apt to rust, and the rusted area creates a resistance not permitting smooth passage of the nut. Thus, a user using a wrench has to apply a considerable force to overcome the resistance resulting from rusting to thereby make the nut pass through the large-resistance position in the rusted area. Therefore, use of conventional hand-driven wrenches is time-consuming and laborsome to the user.

If the torque of a motor of a conventional electric wrench is smaller than the resistance resulting from the rusting on a long bolt, the torque would be insufficient to drive the transmission member and the driving member to rotate, such that the nut cannot pass through the large-resistance position. At this time, an end of the transmission member is still rotated by the motor, and the other end of the transmission member cannot rotate the driving member due to the large resistance. Eventually, the transmission member is continuously distorted and, thus, deforms, and the driving member could disengage from the transmission member due to distortion of the transmission member. The motor could even burn.

In view of the foregoing, the conventional electric wrenches are useless when the torque provided by the motor is smaller than the force encountered by the electric wrenches. The interior structure of the electric wrenches is apt to damage, and the coils of the motor could burn and cause danger.

Thus, a need exists for a novel electric rapid ratchet wrench that mitigates and/or obviates the above disadvantages.

BRIEF SUMMARY OF THE INVENTION

In a first aspect, an electric rapid ratchet wrench includes a body having a first end and a second end opposite to the first end. A driving device is mounted in the first end of the body and is adapted to directly or indirectly drive a fastener to rotate. A power device is mounted to the second end of the body and is configured to provide a torque. A transmission device is mounted between the driving device and the power device. The transmission device is rotatably mounted to the body and is rotatable about a rotating axis. The transmission device is configured to transmit the torque from the power device to drive the driving device. A clutch device is mounted between the driving device and the power device. The clutch device includes a driven member and a driver member. The driven member has a first toothed portion. The driver member has a second toothed portion. Each of the first toothed portion and the second toothed portion has a plurality of teeth. The plurality of teeth of the second toothed portion is movable in a radial direction perpendicular to the rotating axis to disengageably engage with the plurality of teeth of the first toothed portion to thereby switch the clutch device between an engaged state and a disengaged state.

When a resistance smaller than the torque outputted by the power device is encountered while the driving device is driving the fastener, the clutch device is in the engaged state, the second toothed portion of the driver member engages with the first toothed portion of the driven member, the driving device rotates the clutch device and the transmission device, and the driving device is driven by the transmission device to thereby drive the fastener.

When a large resistance larger than the torque outputted by the power device is encountered at a position while the driving device is driving the fastener, the clutch device is in the disengaged state, resulting in a semi-switching phenomenon in which the second toothed portion of the driver member moves in the radial direction to repeatedly engage with and disengage from the first toothed portion of the driven member, such that the power device does not transmit the torque of the power device to the driving device, the body is manually rotatable by a torque larger than the large resistance to overcome the large resistance and to forcibly drive the fastener through the position via the driving device, and the clutch device returns to the engaged state after the fastener passes through the position.

In an example, the clutch device further includes a connecting member having a sliding groove extending in the radial direction. The driver member is movably received in the sliding groove of the connecting member and is movable in the radial direction to disengageably engage with the driven member.

In an example, the clutch device further includes a first elastic element elastically mounted around the driver member and the connecting member. The first elastic element provides an elastic returning force pressing a side of the driver member opposite to the second toothed portion to provide a preset torque value. When the larger resistance encountered is larger than the torque outputted by the power device or the preset torque value of the first elastic element, the clutch device is in the disengaged state, and the driver member presses against the first elastic element to repeatedly and elastically deform the first elastic element.

In an example, the preset torque value is directly proportional to the elastic returning force of the first elastic element. The driver member includes a bottom side and a top side opposite to the bottom side. The second toothed portion is disposed on the bottom side of the driver member and extends in a circumferential direction about the rotating axis. The driver member further includes a first groove in the top side. The connecting member includes an outer periphery having a second groove intercommunicated and aligned with the first groove. The first elastic element is elastically received in the first groove and the second groove and presses against the top side of the driver member with the elastic returning force.

In an example, each of the bottom side and the top side of the driver member is a curved face having a curvature. The curvature of the bottom side is identical to the curvature of the top side. The driver member is an arcuate block.

In an example, the transmission device includes a transmission shaft rotatably mounted in the body and rotatable about the rotating axis. The transmission shaft includes a transmission end and a driving end opposite to the transmission end along the rotating axis. The driven member is mounted on the transmission end. The first toothed portion is located on an outer periphery of the transmission end and extending in the circumferential direction about the rotating axis. The driving end is connected to the driving device.

In an example, the top side of the driver member further includes a third groove extending parallel to the first grieve. The outer periphery of the connecting member further includes a fourth groove intercommunicated and aligned with the third groove. The fourth groove extends parallel to the second groove. The clutch device further includes a second elastic element elastically received in the third groove and the fourth groove. The second elastic element provides an elastic returning force pressing against the top side of the driver member. The elastic returning forces of the first elastic element and the second elastic element together press the top side of the driver member to provide the preset torque value. Each of the first elastic element and the second elastic element has an opening and has substantially C-shaped cross sections perpendicular to the rotating axis.

In an example, the connecting member has a length along the rotating axis. The first elastic element has a width along the rotating axis. A ratio of the length of the connecting member to the width of the first elastic element is smaller than 4:1.

In an example, the preset torque value is not larger than 3 newton meters. The body includes a compartment in the second end thereof, a transmission hole intercommunicated with the compartment, and a driving hole defined in the first end thereof and intercommunicated with the transmission hole. The driving device includes a driving member and a first ring gear rotatably mounted to the driving member. The driving member is rotatably mounted in the driving hole of the body and is configured to directly or indirectly drive the fastener. The first ring gear is configured to drive the driving member to rotate. The first ring gear includes a side toothed portion. The power device is mounted in the compartment of the body. The power device includes a motor connected to the connecting member and a power source electrically connected to the motor. The motor is configured to be powered by the power source to drive the connecting member to rotate about the rotating axis. The transmission device further includes a gear. The transmission shaft is rotatably mounted in the transmission hole of the body and is rotatable about the rotating axis. The gear is mounted to the driving end of the transmission shaft and meshes with the side toothed portion of the first ring gear.

The connecting member includes a proximal end and a distal end opposite to the proximal end. The proximal end of the connecting member is connected to the motor. The distal end of the connecting member includes a connecting hole extending along the rotating axis. The transmission end of the transmission shaft extends into the connecting hole. The connecting hole is intercommunicated with the sliding groove, such that the driven member disposed on the transmission end is movable in the radial direction to disengageably engage with the driver member.

In a second aspect, a method of using an electric rapid ratchet wrench includes:

providing an electric rapid ratchet wrench including a body, a driving device mounted to the body for directly or indirectly driving a fastener, a power device mounted to the body and configured to providing a torque, a transmission device mounted between the driving device and the power device, and a clutch device mounted between the driving device and the power device, with the transmission device rotatably mounted to the body and rotatable about a rotating axis, with the transmission device configured to transmit the torque of the power device to drive the driving device, and with the clutch device switchable between an engaged state and a disengaged state;

coupling the driving device to the fastener;

starting the power device to actuate the clutch device and the transmission device, with the transmission device driving the driving device to rotate the fastener;

wherein when a resistance smaller than the torque outputted by the power device is encountered while the driving device is driving the fastener, the clutch device is in the engaged state, the driving device rotates the clutch device and the transmission device, and the driving device is driven by the transmission device to thereby drive the fastener, and wherein when a large resistance larger than 3 newton meters is encountered at a position while the driving device is driving the fastener, the clutch device is in the disengaged state, such that the power device does not transmit the torque of the power device to the driving device, the body is manually rotatable by a torque larger than 3 newton meters to overcome the large resistance and to forcibly drive the fastener through the position via the driving device, and the clutch device returns to the engaged state after the fastener passes through the position.

The present invention will become clearer in light of the following detailed description of illustrative embodiments of this invention described in connection with the drawings.

DETAILED DESCRIPTION OF THE INVENTION

Figure 1:
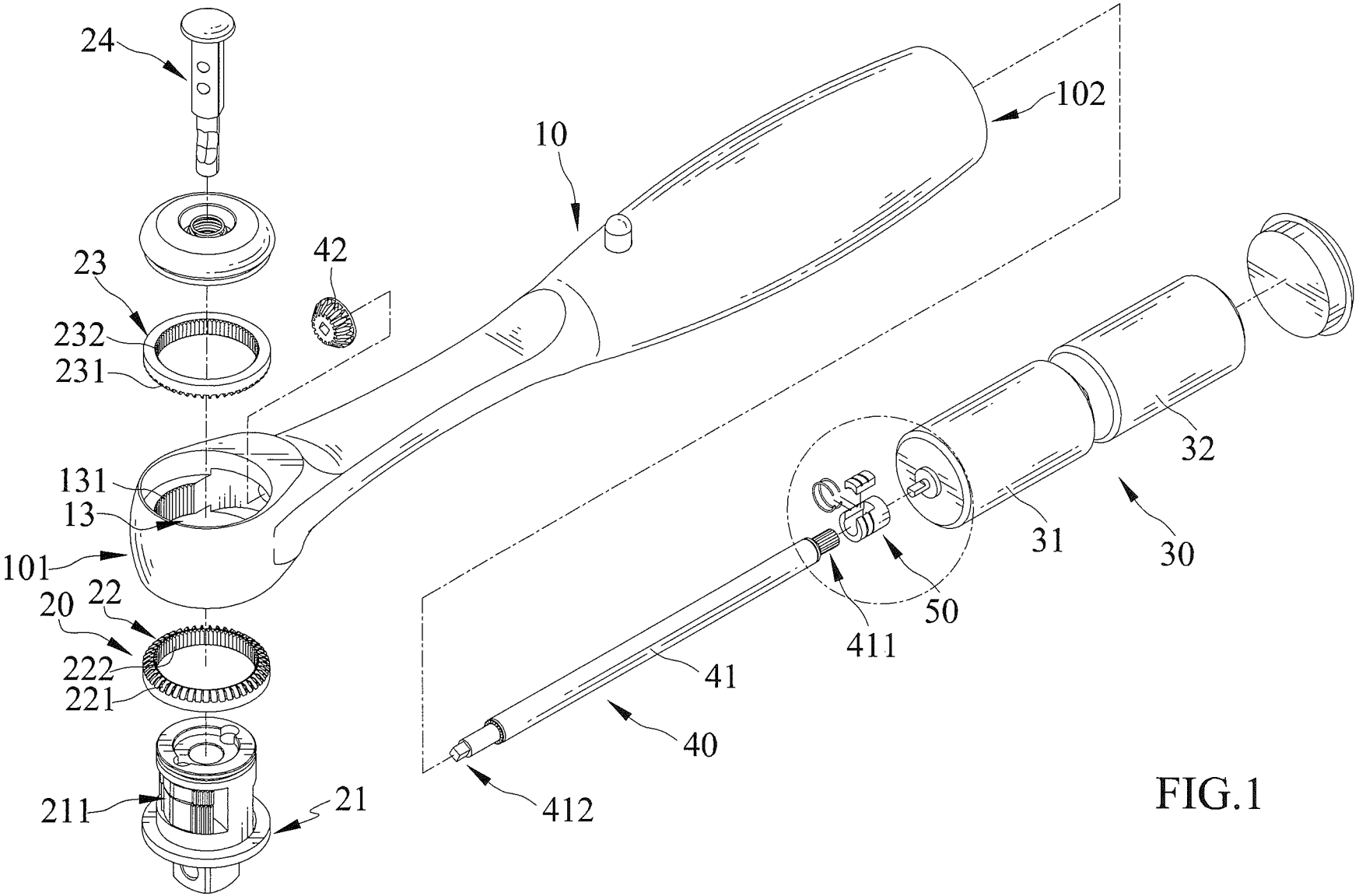
FIG. 1 is an exploded, perspective view of an electric rapid ratchet wrench of a first embodiment according to the present invention.
Figure 2:
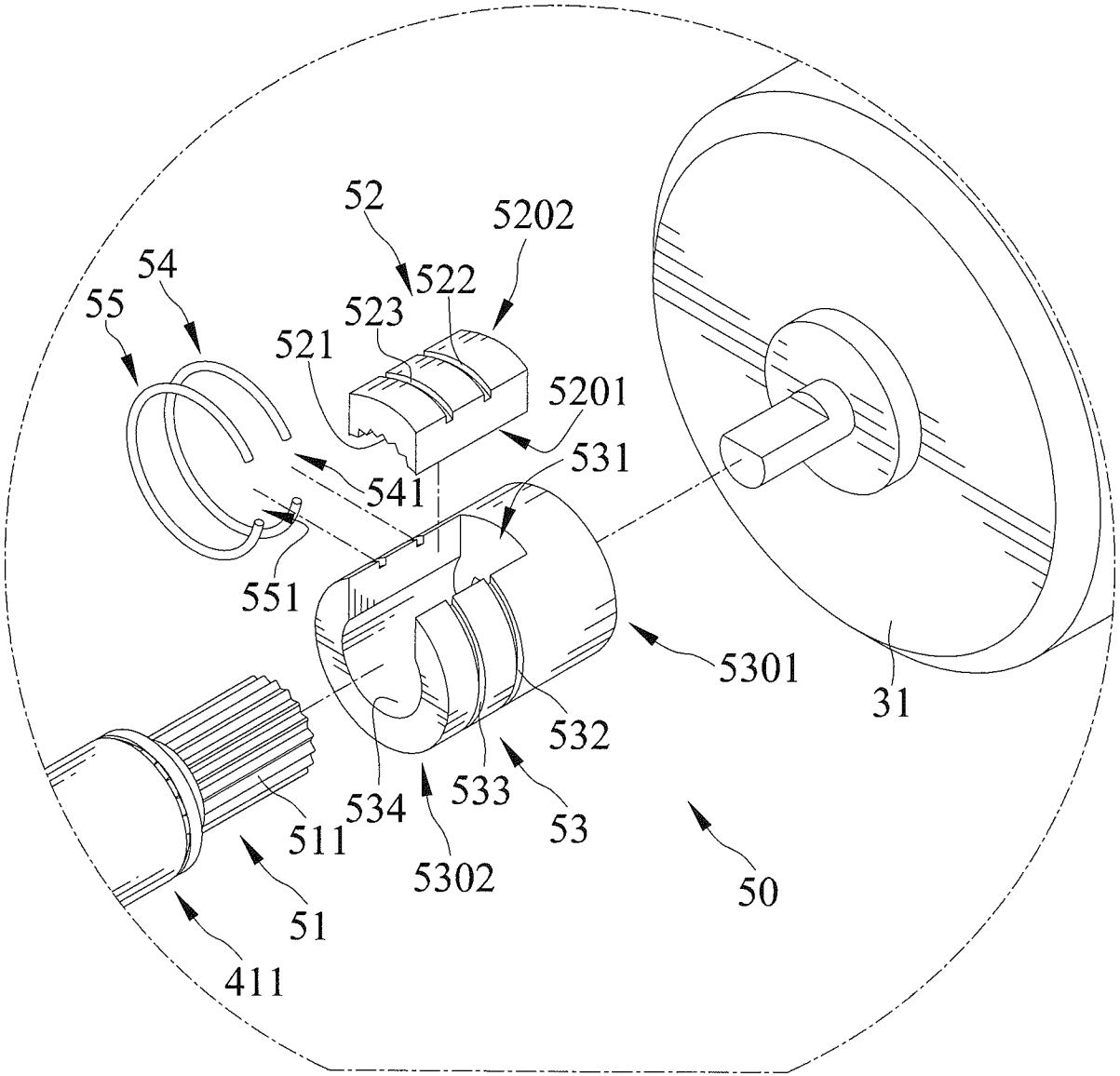
FIG. 2 is an enlarged view of a circled portion of FIG. 1.
Figure 3:
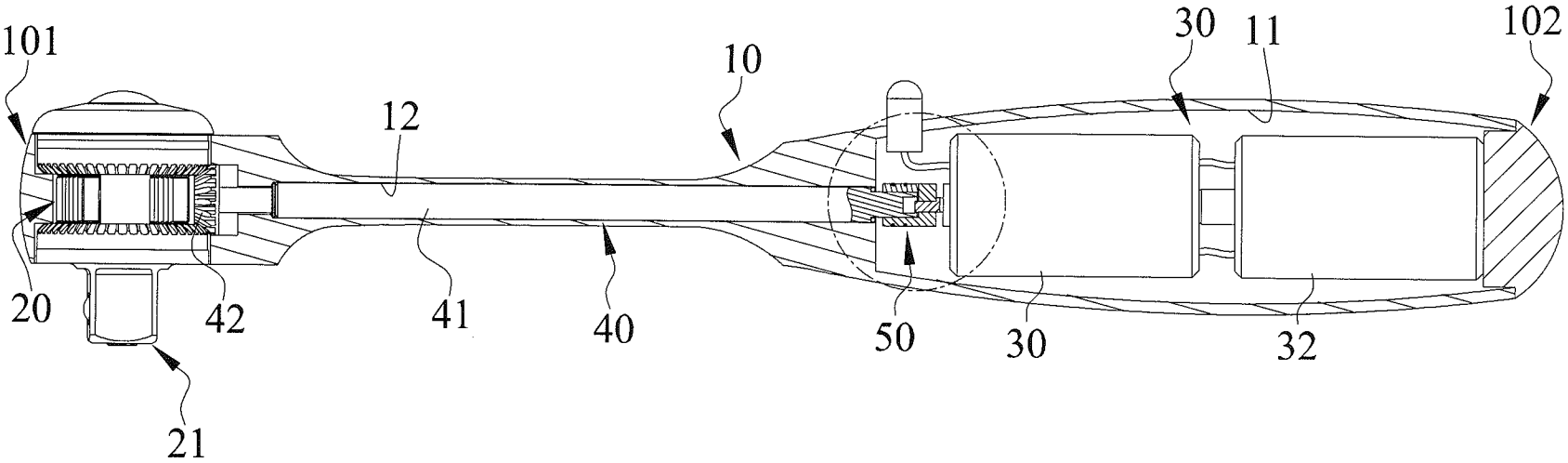
FIG. 3 is a cross sectional view of the electric rapid ratchet wrench of FIG. 1.
Figure 4:
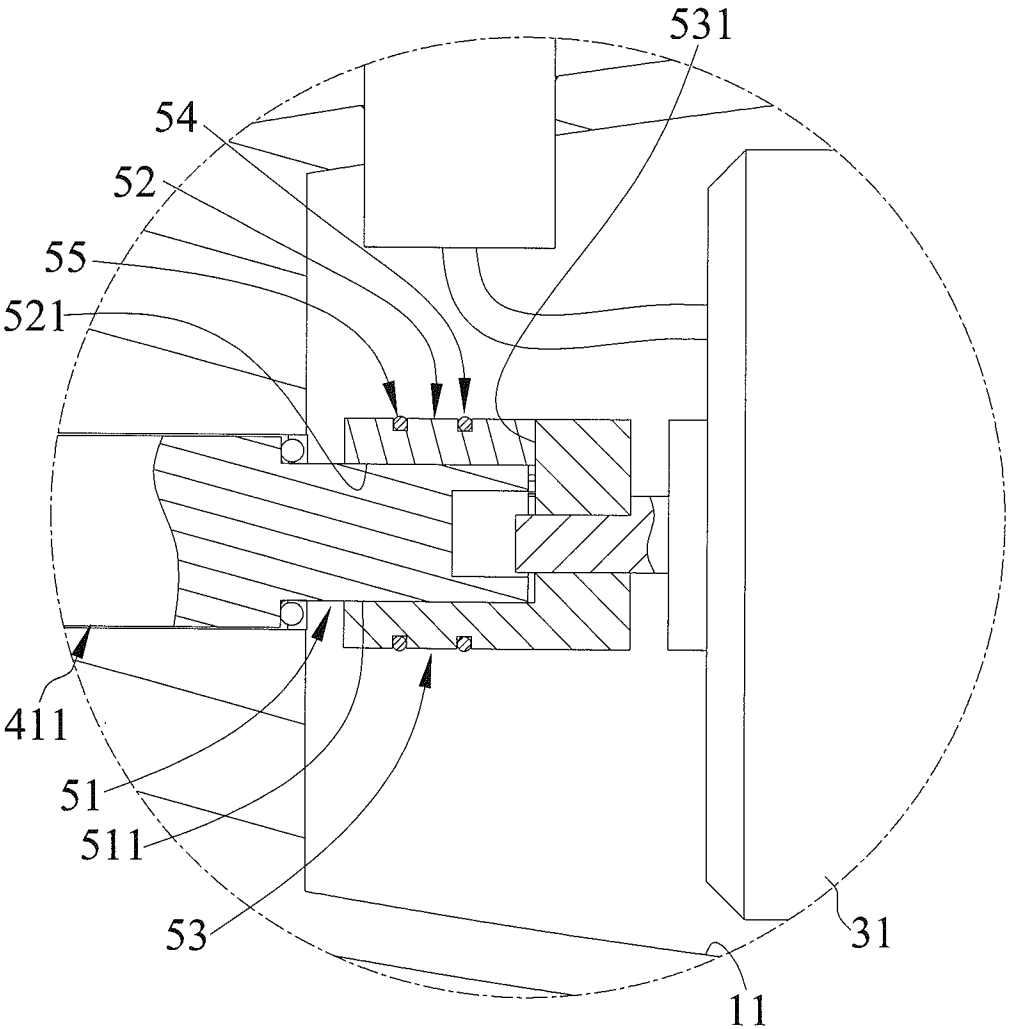
FIG. 4 is an enlarged view of a circled portion of FIG. 3.

With reference to FIGS. 1-4, an electric rapid ratchet wrench of a first embodiment according to the present invention includes a body 10, a driving device 20 mounted to body 10, a power device 30 for providing a torque, a transmission device 40 for transmitting the torque from power device 30, and a clutch device 50 switchable between an engaged state and a disengaged state.

Body 10 includes a first end 101 and a second end 102 opposite to first end 101. Body 10 further includes a compartment 11 in second end 102 and a transmission hole 12 intercommunicated with compartment 11. Power device 30 is received in compartment 11. Transmission device 40 is mounted in transmission hole 12. Body 10 further includes a driving hole 13 defined in first end 101 and intercommunicated with transmission hole 12. Driving hole 13 includes an outer periphery having a toothed portion 131.

Driving device 20 is mounted in driving hole 13 in first end 101 of body 10 and is adapted to directly or indirectly drive a fastener (such as a bolt, a nut, a socket, etc.) to rotate. Driving device 20 includes a driving member 21 and first and second ring gears 22 and 23 rotatably mounted to driving member 21. Driving member 21 is rotatably mounted in driving hole 13 in first end 101 of body 10 and is configured to directly or indirectly drive the fastener. First and second ring gears 22 and 23 can rotate relative to driving member 21 in a clockwise direction or a counterclockwise direction and can drive driving member 21 to rotate. Each of first and second ring gears 22 and 23 includes a side toothed portion 221, 231 and an inner toothed portion 222, 232. Side toothed portions 221 and 231 of first and second ring gears 22 and 23 mesh with and can be driven by transmission device 40. Driving member 21 includes a pawl device 211 selectively meshed with toothed portion 131 of driving hole 13 and selectively meshed with inner toothed portions 222 and 232 of first and second ring gears 22 and 23 to provide a direction switching function.

Driving device 20 further includes a switching rod 24 extending through driving member 21 and pivotable between first and second positions respectively corresponding to a driving direction and a non-driving direction. When switching rod 24 pivots between the first and second positions, the engagement status between pawl device 21 and toothed portion 131 of driving hole 13, the engagement status between pawl device 211 and first ring gear 22, and the engagement status between pawl device 211 and second ring gear 23 can be changed to provide the direction switching function. Pawl device 211 can be of any desired form as conventional including but not limited to of a commercially available type.

Power device 30 is mounted in compartment 11 in second end 102 of body 10 to provide the torque. Power device 30 includes a motor 31 connected to clutch device 50 and a power source 32 electrically connected to motor 31. Motor 31 is configured to be powered by power source 32 to drive clutch device 50. In this embodiment, motor 31 can be a unidirectional or bidirectional motor.

Transmission device 40 is mounted between driving device 20 and power device 30. Transmission device 40 is rotatably mounted to body 10 and is rotatable about a rotating axis R. Transmission device 40 is configured to transmit the torque from motor 31 of power device 30 to drive driving member 21 of driving device 20 to rotate in driving hole 13. Transmission device 40 includes a transmission shaft 41 and a gear 42. Transmission shaft 41 is rotatably mounted in transmission hole 12 of body 10 and is rotatable about rotating axis R. Transmission shaft 41 includes a transmission end 411 and a driving end 412 opposite to transmission end 411 along rotating axis R. Gear 42 is mounted to driving end 412 of transmission shaft 41 and meshes with side toothed portions 221 and 231 of first and second ring gears 221 and 23.

Clutch device 50 is mounted between driving device 20 and power device 30. Clutch device 50 includes a driven member 51 and a driver member 52. Driver member 52 is movable in a radial direction perpendicular to rotating axis R to disengageably engage with driven member 51 to thereby switch clutch device 50 between the engaged state and the disengaged state.

Driven member 51 has a first toothed portion 511. Driver member 52 has a second toothed portion 521. Each of first and second toothed portions 511 and 521 has a plurality of teeth. The teeth of first toothed portion 511 is located on an outer periphery of driven member 51 and extends in the circumferential direction about rotating axis R. Driver member 52 includes a bottom side 5201 and a top side 5202 opposite to bottom side 5201. The teeth of second toothed portion 521 is disposed on bottom side 5201 of driver member 52 and extends in the circumferential direction about rotating axis R. The teeth of first toothed portion 511 face the teeth of second toothed portion 521. The teeth of second toothed portion 521 are movable in the radial direction perpendicular to rotating axis R to disengageably engage with the teeth of first toothed portion 511 to thereby switch clutch device 50 between the engaged state and the disengaged state.

In this embodiment, driven member 51 is mounted on transmission end 411 of transmission shaft 41. Preferably, driven member 51 is integrally formed on transmission end 411 of transmission rod 41. First toothed portion 511 is located on an outer periphery of transmission end 411 and extends in the circumferential direction about rotating axis R. Each of bottom side 5201 and top side 5202 of driver member 52 is a curved face having a curvature. The curvature of bottom side 5201 is identical to the curvature of top side 5202, such that driver member 52 is substantially in the form of an arcuate block.

Clutch device 50 further includes a connecting member 53 having a proximal end 5301 and a distal end 5302 opposite to proximal end 5301. Proximal end 5301 of connecting member 53 is connected to motor 31 of power device 30. Connecting member 53 includes a sliding groove 531 extending in the radial direction. Driver member 52 is movably received in sliding groove 531 of connecting member 53 and is movable in the radial direction. In this embodiment, connecting member 53 is a hollow tube, and distal end 5302 of connecting member 53 includes a connecting hole 534 extending along rotating axis R. Transmission end 411 of transmission shaft 41 extends into connecting hole 534. Connecting hole 534 intercommunicates with sliding groove 531, such that after driven member 51 disposed on transmission end 411 has been inserted into connecting hole 534, driven member 51 is movable in the radial direction to disengageably engage with driver member 52.

Clutch device 50 further includes a first elastic element 54 elastically mounted around driver member 52 and connecting member 53. Driver member 52 further includes a first groove 522 in top side 5202. Connecting member 53 includes an outer periphery having a second groove 532 intercommunicated and aligned with first groove 532. First elastic element 54 is elastically received in first groove 522 and second groove 532 and presses against top side 5202 of driver member 52 with its elastic returning force.

Top side 5202 of driver member 52 further includes a third groove 523 extending parallel to first grieve 522. The outer periphery of connecting member 53 further includes a fourth groove 533 intercommunicated and aligned with third groove 523. Fourth groove 533 extends parallel to second groove 532. Clutch device 50 further includes a second elastic element 55 elastically received in third groove 523 and fourth groove 533. Second elastic element 55 provides an elastic returning force pressing against top side 5202 of driver member 52. The elastic returning forces of first and elastic elements 54 and 55 together press top side 5202 of driver member 52 to provide a preset torque value. The preset torque value is directly proportional to the elastic returning forces of first and second elastic elements 54 and 55. In this embodiment, the preset torque value is not larger than 3 newton meters and is preferably not larger than 0.5 newton meters.

In this embodiment, each of first and second elastic elements 54 and 55 has an opening 541, 551 and, thus, has substantially C-shaped cross sections perpendicular to rotating axis R. Thus, first elastic element 54 can be easily mounted in first and second grooves 522 and 532, and second elastic element 55 can be easily mounted in third and fourth grooves 523 and 533.

A user can directly or indirectly couple driving member 21 of driving device 20 to a fastener and then start motor 31 of power device 30 to drive driven member 51 and driver member 52 of clutch device 50 and transmission shaft 41 and gear 42 of transmission device 40. Gear 42 meshes with side toothed portions 221 and 231 of first and second ring gears 22 and 23 to thereby drive first and second ring gears 22 and 23, which, in turn, drive driving member 21 to rotate the fastener.

Figure 5B:
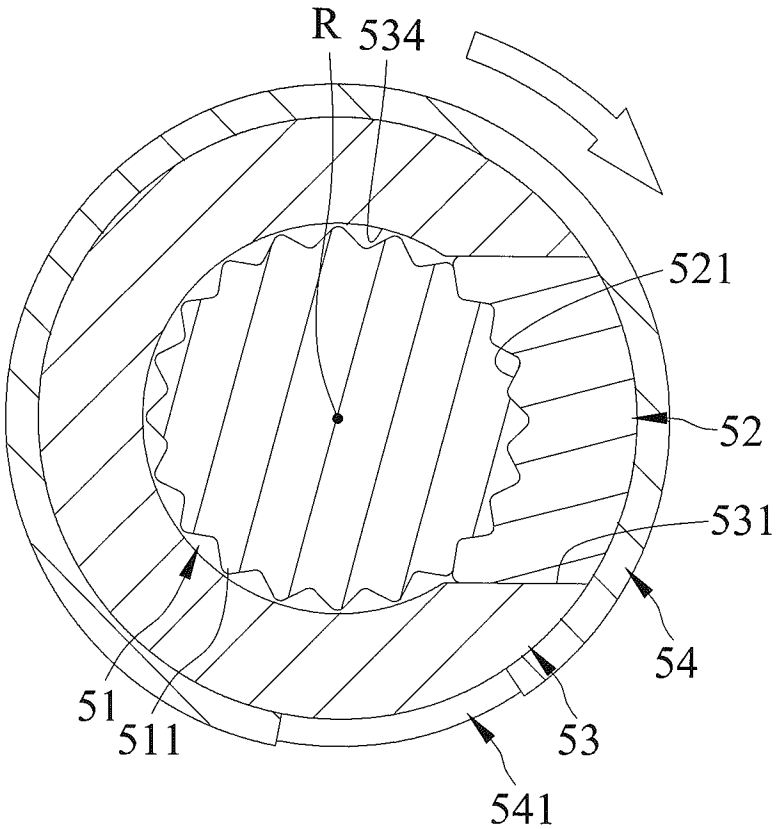
FIG. 5B is a view similar to FIG. 5A, illustrating synchronous rotation of the driven member and the driver member.
Figure 5A:
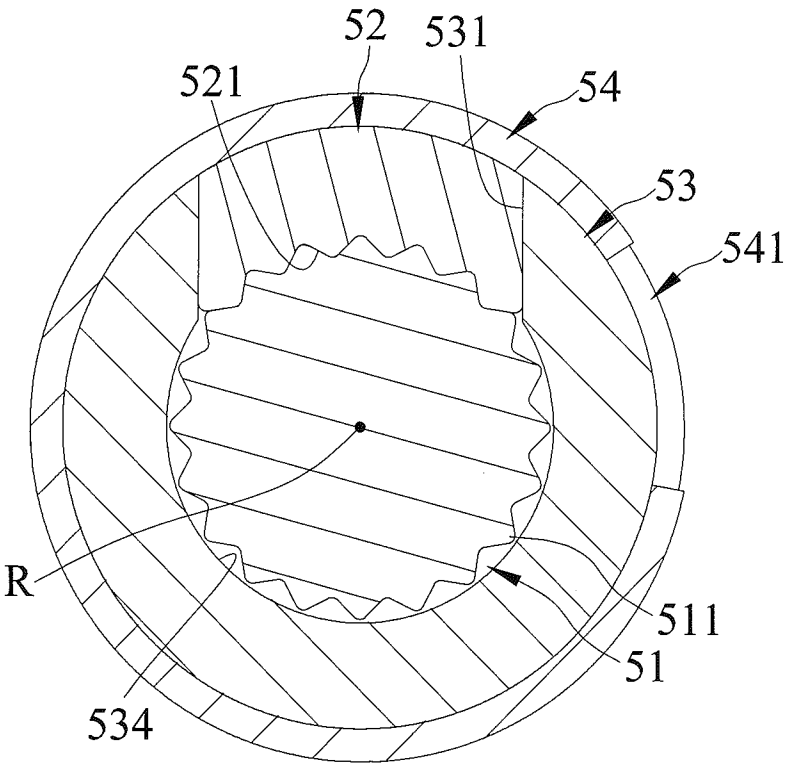
FIG. 5A is a cross sectional view of the electric rapid ratchet wrench of FIG. 1, with a clutch device in an engaged state and with a driven member engaged with a driver member.

With reference to FIGS. 5A and 5B, when a resistance smaller than the torque outputted by the motor 31 or the preset torque value of first and second elastic elements 54 and 55 is encountered while driving device 20 is driving the fastener, clutch device 50 is in the engaged state, top side 5202 of driver member 52 and the outer periphery of connecting member 53 are coplanar. Driver member 52 is connected to driven member 51. Motor 31 rotates connecting member 53, and connecting member 53 drives driven member 51 and driver member 52 to rotate in a direction indicated by an arrow shown in FIG. 5B. Second toothed portion 521 of driver member 52 meshes with first toothed portion 511 of driven member 51. Driven member 51 drives transmission shaft 41 and gear 42 of transmission device 40 to rotate relative to transmission hole 12. First and second ring gears 22 and 23 of driving device 20 are driven by gear 42 to rotate driving member 21 to rapidly drive the fastener, achieving a time-saving effect and a force-saving effect.

Figure 6B:
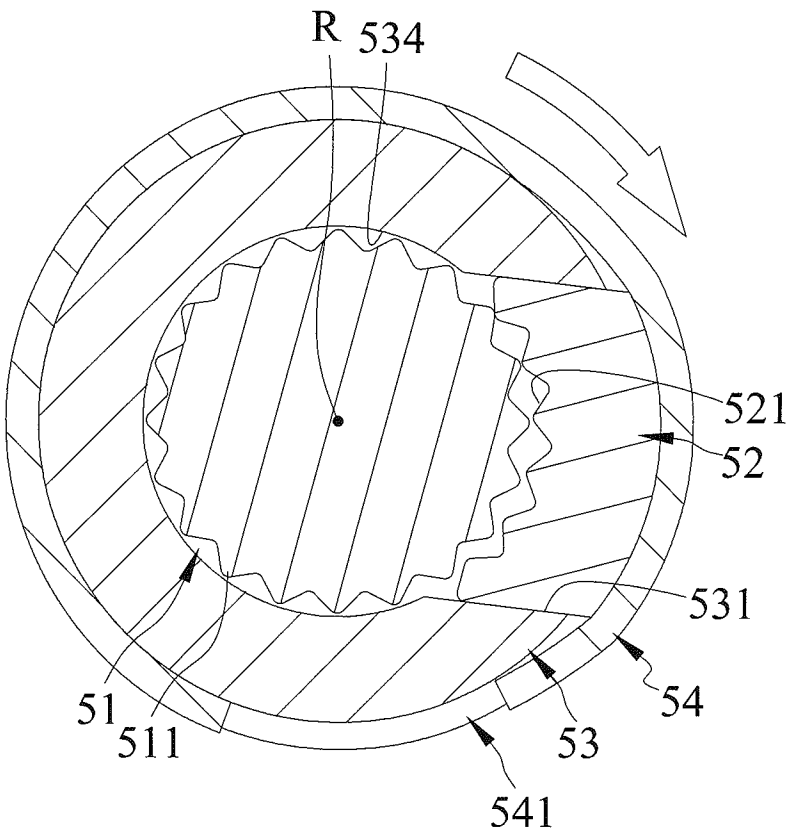
FIG. 6B is a view similar to FIG. 6A, illustrating a semi-clutching phenomenon of repeated engagement and disengagement between the driven member and the driver member.
Figure 6A:
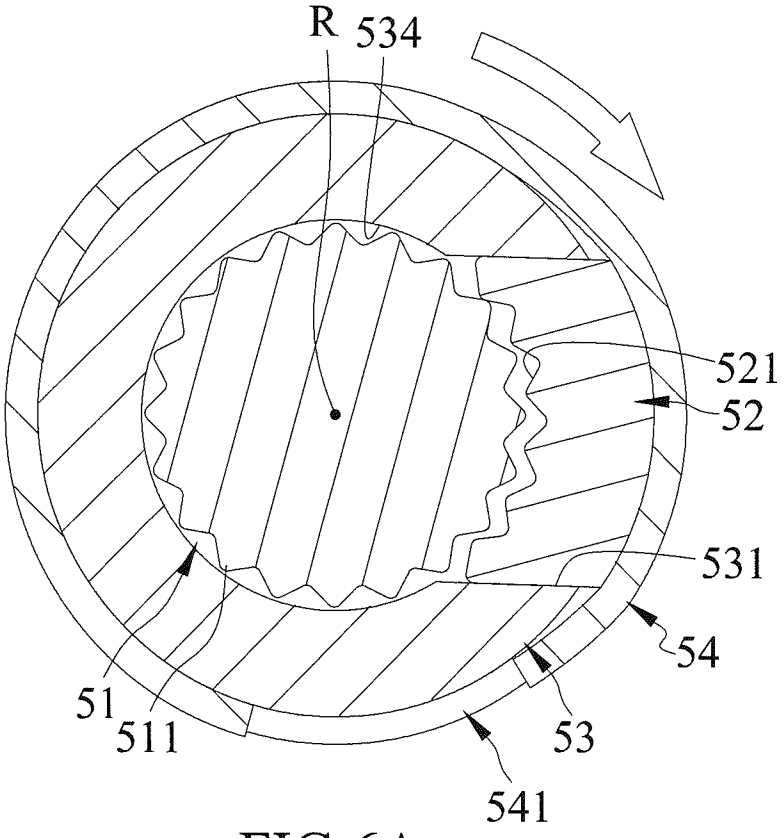
FIG. 6A is a view similar to FIG. 5B, with the clutch device in a disengaged state and with the driver member moved relative to a sliding groove in a radial direction perpendicular a rotating axis.

With reference to FIGS. 6A and 6B, when a large resistance larger than the torque outputted by motor 31 or the preset torque value of first and second elastic elements 54 and 55 is encountered at a position while driving device 20 is driving the fastener (for example, a nut stuck at a rusted area of a rusted long bolt on a building construction site), the nut cannot pass through the rusted area (the large resistance position), and clutch device 50 is in the disengaged state. At this time, since motor 31 is still running, driver member 52 moves in the radial direction relative to sliding groove 531 of connecting member 53, causing a semi-switching phenomenon in which second toothed portion 521 of driver member 52 moves in the radial direction to repeatedly engage with and disengage from first toothed portion 511 of driven member 51. Since the tooth type of second toothed portion 521 of driver member 52 matches with the toothed type of first toothed portion 511 of driven member 51, driver member 52 rotates around driven member 51 about rotating axis R and repeatedly slides relative to sliding groove 531 of connecting member 53, such that top side 5202 of driver member 52 presses against first and second elastic elements 54 and 55, causing repeated deformation of first and second elastic elements 54 and 55 (which expand openings 541 and 551). As a result, power device 40 cannot transmit the torque of motor 31 to driving device 20.

The user can hear clicks resulting from the semi-clutching phenomenon between driven member 51 and driver member 52. In this case, the user can manually rotate body 10 with a torque larger than the resistance at the large-resistance position, using toothed portion 131 of body 10 to mesh with pawl device 211 to thereby drive the driving member 21, thereby forcing the fastener to pass through the large-resistance position. After the fastener passes through the large-resistance position, the driver member 52 reengages with driven member 51 under the elastic returning forces of first and second elastic elements 54 and 55 and stops sliding relative to sliding groove 531 of connecting member 53. Thus, clutch device 50 switches to the engaged state and can continuously and rapidly drive the fastener again. This overcomes the disadvantage of failing to drive driving device 20 through transmission device 40 resulting from the large resistance larger than the torque outputted by motor 31 encountered while driving device 20 is driving the fastener. Furthermore, the preset torque value prevents damage to power device 30 and transmission device 40 resulting from the large resistance while power device 30 is running.

Figure 7:
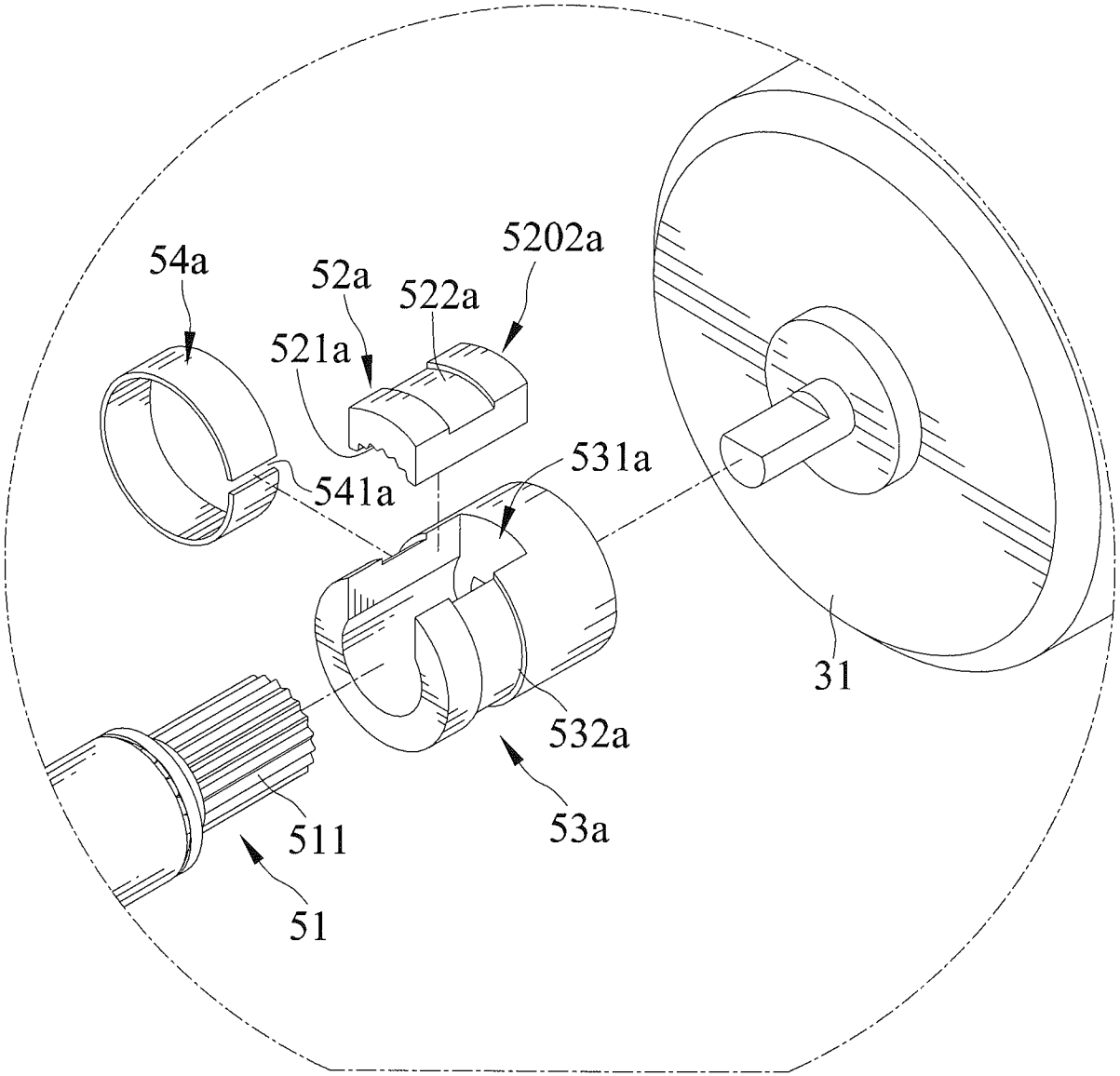
FIG. 7 is a partial, exploded, perspective view of an electric rapid ratchet wrench of a second embodiment according to the present invention.
Figure 8:
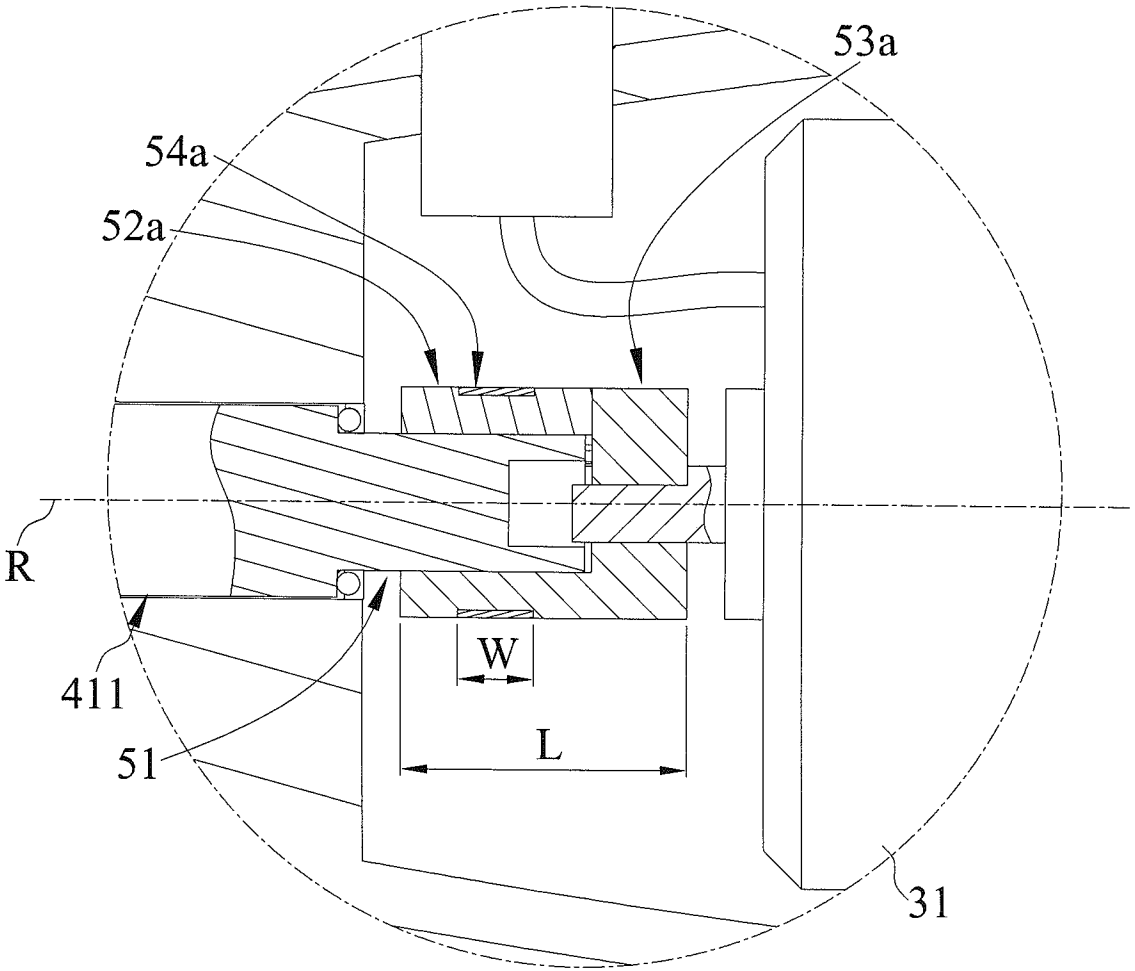
FIG. 8 is a cross sectional view of the electric rapid ratchet wrench of FIG. 7.

FIGS. 7 and 8 show an electric rapid ratchet wrench of a second embodiment according to the present invention substantially the same as the first embodiment. In the second embodiment, top side 5202*a* of driver member 52*a* only includes a first groove 522*a*, and the outer periphery of connecting member 53*a* only includes a second groove 532*a* intercommunicated and aligned with first groove 522*a*. Furthermore, the second embodiment only includes a first elastic element 54*a* having an opening 541*a*, such that first elastic element 54*a* has C-shaped cross sections perpendicular to rotating axis R, permitting easy installation of first elastic element 54*a* in first and second grooves 522*a* and 532*a*. Furthermore, in this embodiment, connecting member 53*a* has a length L along rotating axis R, and first elastic element 54*a* has a width W along rotating axis R. The ratio of length L of connecting member 53*a* to width W of first elastic element 54*a* is smaller than 4:1. Thus, first elastic element 54*a* is band-like and provides its elastic returning force to uniformly press against top side 5202*a* of driver member 52*a*, thereby providing a preset torque value that is directly proportional to the elastic returning force of first elastic element 54*a*.

Accordingly, a method of using an electric rapid ratchet wrench according to the present invention includes:

providing an electric rapid ratchet wrench including a body 10, a driving device 20 mounted to body 10 for directly or indirectly driving a fastener, a power device 30 mounted to body 10 and configured to providing a torque, a transmission device 40 mounted between driving device 20 and power device 30, and a clutch device 50 mounted between driving device 20 and power device 30, with transmission device 40 rotatably mounted to body 10 and rotatable about a rotating axis R, with transmission device 40 configured to transmit the torque of power device 30 to drive driving device 20, and with clutch device 50 switchable between an engaged state and a disengaged state;

coupling driving device 20 to the fastener;

starting power device 30 to actuate clutch device 50 and transmission device 40, with transmission device 40 driving the driving device 20 to rotate the fastener, wherein when a resistance smaller than the torque outputted by power device 30 is encountered while driving device 20 is driving the fastener, clutch device 50 is in the engaged state, driving device 30 rotates clutch device 50 and transmission device 40, and driving device 20 is driven by transmission device 40 to thereby drive the fastener, and wherein when a large resistance larger than 3 newton meters is encountered at a position while driving device 20 is driving the fastener, clutch device 50 is in the disengaged state, such that power device 40 does not transmit the torque of power device 30 to driving device 20, body 10 is manually rotatable by a torque larger than 3 newton meters to overcome the large resistance and to forcibly drive the fastener through the position via driving device 20, and clutch device 50 returns to the engaged state after the fastener passes through the position.

Although specific embodiments have been illustrated and described, numerous modifications and variations are still possible without departing from the scope of the invention. The scope of the invention is limited by the accompanying claims.

The invention claimed is:

1. An electric rapid ratchet wrench comprising:

a body including a first end and a second end opposite to the first end;

a driving device mounted in the first end of the body and adapted to directly or indirectly drive a fastener to rotate;

a power device mounted to the second end of the body and configured to provide a torque;

a transmission device mounted between the driving device and the power device, with the transmission device rotatably mounted to the body and rotatable about a rotating axis, with the transmission device configured to transmit the torque from the power device to drive the driving device; and a clutch device mounted between the driving device and the power device, with the clutch device including a driven member, a connecting member and a driver member, with the driven member having a first toothed portion, with the connecting member having no toothed portion with the driver member having a second toothed portion, with each of the first toothed portion and the second toothed portion having a plurality of teeth, the connection member and the driver member being arranged together to form an inner circumference with teeth only along part of the circumference, with the plurality of teeth of the second toothed portion movable in a radial direction perpendicular to the rotating axis to disengageably engage with the plurality of teeth of the first toothed portion to thereby switch the clutch device between an engaged state and a disengaged state, wherein when a resistance smaller than the torque outputted by the power device is encountered while the driving device is driving the fastener, the clutch device is in the engaged state, the second toothed portion of the driver member engages with the first toothed portion of the driven member, the driving device rotates the clutch device and the transmission device, and the driving device is driven by the transmission device to thereby drive the fastener, and wherein when a large resistance larger than the torque outputted by the power device is encountered at a position while the driving device is driving the fastener, the clutch device is in the disengaged state, resulting in a semi-switching phenomenon in which the second toothed portion of the driver member moves in the radial direction to repeatedly engage with and disengage from the first toothed portion of the driven member, such that the power device does not transmit the torque of the power device to the driving device, the body is manually rotatable by a torque larger than the large resistance to overcome the large resistance and to forcibly drive the fastener through the position via the driving device, and the clutch device returns to the engaged state after the fastener passes through the position.

2. The electric rapid ratchet wrench as claimed in claim 1, with the connecting member having a sliding groove extending in the radial direction, with the driver member movably received in the sliding groove of the connecting member and movable in the radial direction to disengageably engage with the driven member.

3. An electric rapid ratchet wrench comprising:

a body including a first end and a second end opposite to the first end;

a driving device mounted in the first end of the body and adapted to directly or indirectly drive a fastener to rotate;

a power device mounted to the second end of the body and configured to provide a torque;

a transmission device mounted between the driving device and the power device, with the transmission device rotatably mounted to the body and rotatable about a rotating axis, with the transmission device configured to transmit the torque from the power device to drive the driving device; and a clutch device mounted between the driving device and the power device, with the clutch device including a driven member and a driver member, with the driven member having a first toothed portion, with the driver member having a second toothed portion, with each of the first toothed portion and the second toothed portion having a plurality of teeth, with the plurality of teeth of the second toothed portion movable in a radial direction perpendicular to the rotating axis to disengageably engage with the plurality of teeth of the first toothed portion to thereby switch the clutch device between an engaged state and a disengaged state, wherein when a resistance smaller than the torque outputted by the power device is encountered while the driving device is driving the fastener, the clutch device is in the engaged state, the second toothed portion of the driver member engages with the first toothed portion of the driven member, the driving device rotates the clutch device and the transmission device, and the driving device is driven by the transmission device to thereby drive the fastener, and wherein when a large resistance larger than the torque outputted by the power device is encountered at a position while the driving device is driving the fastener, the clutch device is in the disengaged state, resulting in a semi-switching phenomenon in which the second toothed portion of the driver member moves in the radial direction to repeatedly engage with and disengage from the first toothed portion of the driven member, such that the power device does not transmit the torque of the power device to the driving device, the Body is manually rotatable by a torque larger than the large resistance to overcome the large resistance and to forcibly drive the fastener through the position via the driving device, and the clutch device returns to the engaged state after the fastener passes through the position;

with the clutch device further including a connecting member having a sliding groove extending in the radial direction, with the driver member movably received in the sliding groove of the connecting member and movable in the radial direction to disengageably engage with the driven member;

with the clutch device further including a first elastic element elastically mounted around the driver member and the connecting member, with the first elastic element providing an elastic returning force pressing a side of the driver member opposite to the second toothed portion to provide a preset torque value, wherein when the larger resistance encountered is larger than the torque outputted by the power device or the preset torque value of the first elastic element, the clutch device is in the disengaged state, and the driver member presses against the first elastic element to repeatedly and elastically deform the first elastic element.

4. The electric rapid ratchet wrench as claimed in claim 3, with the preset torque value being directly proportional to the elastic returning force of the first elastic element, with the driver member including a bottom side and a top side opposite to the bottom side, with the second toothed portion disposed on the bottom side of the driver member and extending in a circumferential direction about the rotating axis, with the driver member further including a first groove in the top side, with the connecting member including an outer periphery having a second groove intercommunicated and aligned with the first groove, with the first elastic element elastically received in the first groove and the second groove and pressing against the top side of the driver member with the elastic returning force.

5. The electric rapid ratchet wrench as claimed in claim 4, with each of the bottom side and the top side of the driver member being a curved face having a curvature, with the curvature of the bottom side identical to the curvature of the top side, and with the driver member being an arcuate block.

6. The electric rapid ratchet wrench as claimed in claim 5, with the transmission device including a transmission shaft rotatably mounted in the Body and rotatable about the rotating axis, with the transmission shaft including a transmission end and a driving end opposite to the transmission end along the rotating axis, with the driven member mounted on the transmission end, with the first toothed portion located on an outer periphery of the transmission end and extending in the circumferential direction about the rotating axis, and with the driving end connected to the driving device.

7. The electric rapid ratchet wrench as claimed in claim 6, with the top side of the driver member further including a third groove extending parallel to the first groove, with the outer periphery of the connecting member further including a fourth groove intercommunicated and aligned with the third groove, with the fourth groove extending parallel to the second groove, with the clutch device further including a second elastic element elastically received in the third groove and the fourth groove, with the second elastic element providing an elastic returning force pressing against the top side of the driver member, with the elastic returning forces of the first elastic element and the second elastic element together pressing the top side of the driver member to provide the preset torque value, with each of the first elastic element and the second elastic element having an opening and having substantially C-shaped cross sections perpendicular to the rotating axis.

8. The electric rapid ratchet wrench as claimed in claim 6, with the connecting member having a length along the rotating axis, with the first elastic element having a width along the rotating axis, wherein a ratio of the length of the connecting member to the width of the first elastic element is smaller than 4:1.

9. The electric rapid ratchet wrench as claimed in claim 6, with the connecting member having a length along the rotating axis, with the first elastic element having a width along the rotating axis, wherein a ratio of the length of the connecting member to the width of the first elastic element is 4:1.

10. The electric rapid ratchet wrench as claimed in claim 6, with the preset torque value being not larger than 3 newton meters, with the body including a compartment in the second end thereof, a transmission hole intercommunicated with the compartment, and a driving hole defined in the first end thereof and intercommunicated with the transmission hole, with the driving device including a driving member and a first ring gear rotatably mounted to the driving member, with the driving member rotatably mounted in the driving hole of the body and configured to directly or indirectly drive the fastener, with the first ring gear configured to drive the driving member to rotate, with the first ring gear including a side toothed portion, with the power device mounted in the compartment of the body, with the power device including a motor connected to the connecting member and a power source electrically connected to the motor, with the motor configured to be powered by the power source to drive the connecting member to rotate about the rotating axis, with the transmission device further including a gear, with the transmission shaft rotatably mounted in the transmission hole of the body and rotatable about the rotating axis, with the gear mounted to the driving end of the transmission shaft and meshed with the side toothed portion of the first ring gear, with the connecting member including a proximal end and a distal end opposite to the proximal end, with the proximal end of the connecting member connected to the motor, with the distal end of the connecting member including a connecting hole extending along the rotating axis, with the transmission end of the transmission shaft extending into the connecting hole, wherein the connecting hole is intercommunicated with the sliding groove, such that the driven member disposed an the transmission end is movable in the radial direction to disengageably engage with the driver member.

11. A method of using an electric rapid ratchet wrench, comprising:

providing an electric rapid ratchet wrench including a body, a driving device mounted to the body for directly or indirectly driving a fastener, a power device mounted to the body and configured to providing a torque, a transmission device mounted between the driving device and the power device, and a clutch device mounted between the driving device and the power device, with the transmission device rotatably mounted to the body and rotatable about a rotating axis, with the transmission device configured to transmit the torque of the power device to drive the driving device, and with the clutch device including a driven member, a connecting member and a driver member, the connection member and the driver member being arranged together to form an inner circumference with teeth only along part of the circumference, and being switchable between an engaged state and a disengaged state;

coupling the driving device to the fastener;

starting the power device to actuate the clutch device and the transmission device, with the transmission device driving the driving device to rotate the fastener;

wherein when a resistance smaller than the torque outputted by the power device is encountered while the driving device is driving the fastener, the clutch device is in the engaged state, the driving device rotates the clutch device and the transmission device, and the driving device is driven by the transmission device to thereby drive the fastener, and wherein when a large resistance larger than 3 newton meters is encountered at a position while the driving device is driving the fastener, the driver member moves in the radial direction so that the clutch device is in the disengaged state, such that the power device does not transmit the torque of the power device to the driving device, the body is manually rotatable by a torque larger than 3 newton meters to overcome the large resistance and to forcibly drive the fastener through the position via the driving device, and the clutch device returns to the engaged state after the fastener passes through the position.

* * * * *